United States Patent [19]

Buchegger

[11] Patent Number: 5,009,092

[45] Date of Patent: Apr. 23, 1991

[54] COILER ARRANGEMENT

[75] Inventor: Rudolf Buchegger, Florian

[73] Assignee: Voest-Alpine Industrieanlagenbau GmbH, Linz, Austria

[21] Appl. No.: 525,161

[22] Filed: May 16, 1990

[30] Foreign Application Priority Data

Jun. 8, 1989 [AT] Austria ..... 1413/89

[51] Int. Cl.[5] ..... B21C 47/04

[52] U.S. Cl. ..... 72/148; 72/202

[58] Field of Search ..... 72/128, 146, 148, 200, 72/202; 242/78.1, 78.8

[56] References Cited

U.S. PATENT DOCUMENTS

| | | | |
|---|---|---|---|
| 2,628,790 | 2/1953 | Schmidt et al. | 72/148 X |
| 2,646,231 | 7/1953 | Frielinghaus | 72/148 |
| 2,658,741 | 11/1953 | Schmidt et al. | 72/200 X |
| 2,675,720 | 4/1954 | Ferm | 72/148 |
| 3,331,232 | 7/1967 | King | 72/365 |
| 4,263,798 | 4/1981 | Wladika et al. | 72/202 |
| 4,319,474 | 3/1982 | Gronbech | 72/229 |
| 4,442,690 | 4/1984 | Hirschmanner et al. | 72/128 |
| 4,485,651 | 12/1984 | Tippins et al. | 82/148 X |
| 4,703,640 | 11/1987 | Buchegger et al. | 72/128 |
| 4,761,983 | 8/1988 | Ginzberg et al. | 72/148 |

FOREIGN PATENT DOCUMENTS

| | | | |
|---|---|---|---|
| 59-191502 | 10/1984 | Japan | 72/202 |
| 1-122605 | 5/1989 | Japan | 72/148 |
| 420355 | 11/1934 | United Kingdom . | |

*Primary Examiner*—E. Michael Combs

*Attorney, Agent, or Firm*—Hopgood, Calimafde, Kalil, Blaustein & Judlowe

[57] ABSTRACT

In a coiler arrangement having a housing and a mandrel penetrating the housing, rolling stock to be wound on and off the mandrel is conveyable from a roller table guiding the rolling stock through an opening of the housing to the mandrel by a pivot flap extending from the roller table to the vicinity of the mandrel and movable by a pivot drive. In order to be able to close the opening of the housing almost entirely during the coiling procedure, the pivot mounting of the pivot flap is realized on the periphery of the housing at a distance from the roller table, i.e., at a distance from the roller way formed by the table rollers. The pivot flap, with its free end, is pivotable into the roller way and, vice versa, is pivotable away from the roller way by closing the housing. At least one flap part is provided to extend the pivot flap in the direction opposite to its free end. The end of the flap part facing away from the pivot axis is pivotable from the region of the mandrel to the housing and vice versa.

7 Claims, 2 Drawing Sheets

COILER ARRANGEMENT

Figure 1:
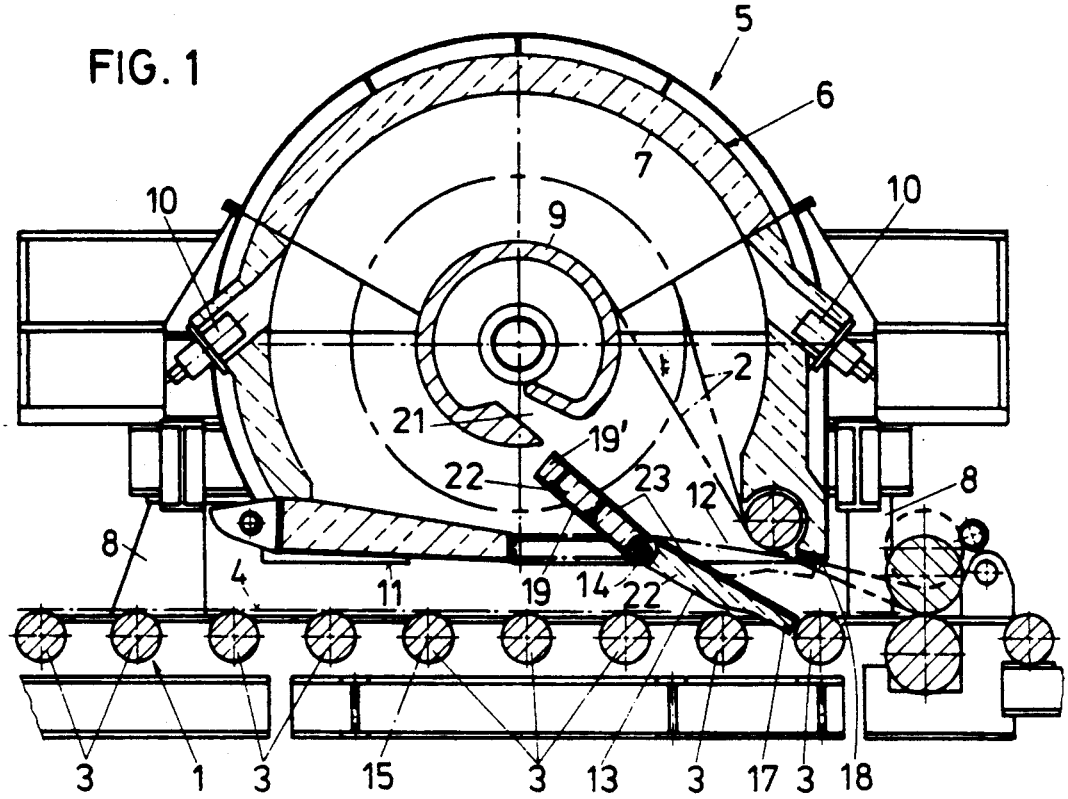

The invention relates to a coiler having a housing and a rotatable mandrel mounted within the housing, rolling stock to be wound on and off the mandrel being conveyable from a roller table guiding the rolling stock through an opening of the housing to the mandrel by means of a pivot flap extending from the roller table to the vicinity of the mandrel and movable by a pivot drive.

A coiler of this type is known from U.S. Pat. No. 3,331,232. With this known coiler, the pivot flap is movable about a pivot axis arranged between two rolls of the roller table. It can be moved from a position lowered between the rolls for the purpose of feeding the hot strip to the roll stand into a position in which the free end of the pivot flap projects towards the mandrel of the coiler such that the end of the hot strip can be seized by the mandrel of the coiler.

The housing of the coiler has a relatively large opening, through which the pivot flap may be pivoted in and out. Thus, energy losses occur during the rolling of hot strip. Furthermore, the pivot flap requires a particular design of the table rollers arranged within its pivot region in order to enable the complete immersion of the pivot flap within the roller table, i.e., below the roller way formed by the rollers.

The invention aims at avoiding these disadvantages and difficulties and has as its object to provide a coiler of the initially defined kind, wherein the opening of the housing is closable almost completely during coiling in a manner that only a gap remains clear, which allows for the passage of the hot strip, and wherein the opening of the housing is closable completely during the coiling procedures by means of a pivot flap assembly without interrupting the roller table thereby. Another object of the invention is to be seen in doing without a particular design of the table rollers with a view to enabling the arrangement of the coiler at any point of the roller table without any major modifications.

In accordance with the invention, this object is achieved in that the pivot mounting of the pivot flap assembly is realized on the periphery of the housing at a distance from the roller table, i.e., at a distance from the roller way formed by the table rollers, and that the pivot flap (i.e., the first flap portion), with its free end, is pivotable into the roller way and, vice versa, is pivotable away from the roller way by closing the housing, and that at least one flap part (i.e., the second flap portion) is provided to extend the pivot flap or the first flap portion in the direction opposite to its free end, the end of which flap part or second flap portion that faces away from the pivot axis is pivotable from the region of the mandrel to the housing and vice versa.

The construction is particularly simple if the flap part extending the pivot flap is designed in one piece with the pivot flap.

In order to avoid energy losses in a particularly effective manner, the flap part extending the pivot flap of the assembly is articulately connected to the pivot flap and is pivotable by means of a separate pivot drive independently of the pivot flap, the flap part extending the pivot flap advantageously being hinged to the pivot axis of the pivot flap.

In order to reduce the energy losses incurred during threading of the hot strip into the coiler mandrel, the flap part extending the pivot flap, on its end facing away from the pivot flap, advantageously is articulately connected with a wall part of the housing of the mandrel, which housing wall part is movably mounted on the housing.

A preferred embodiment is characterized in that the flap part extending the pivot flap is pivotably mounted on the housing in a manner separated from the pivot flap.

Preferably, the pivot flap and the flap part extending the pivot flap are provided with heat insulating means, the pivot flap and the part extending the pivot flap, thus, constituting no weak points in respect of the heat insulation of a thermally insulated housing.

Figure 2:
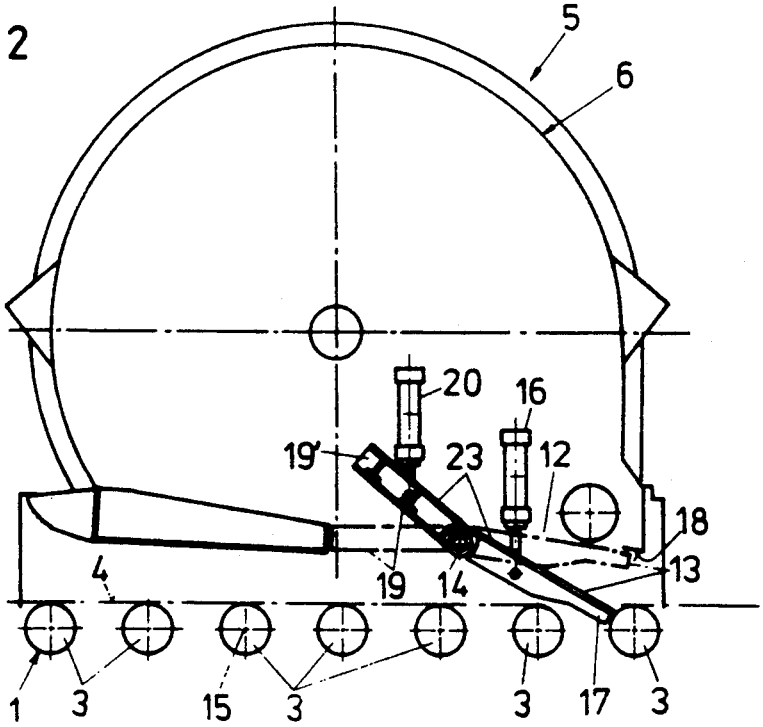
Figure 3:
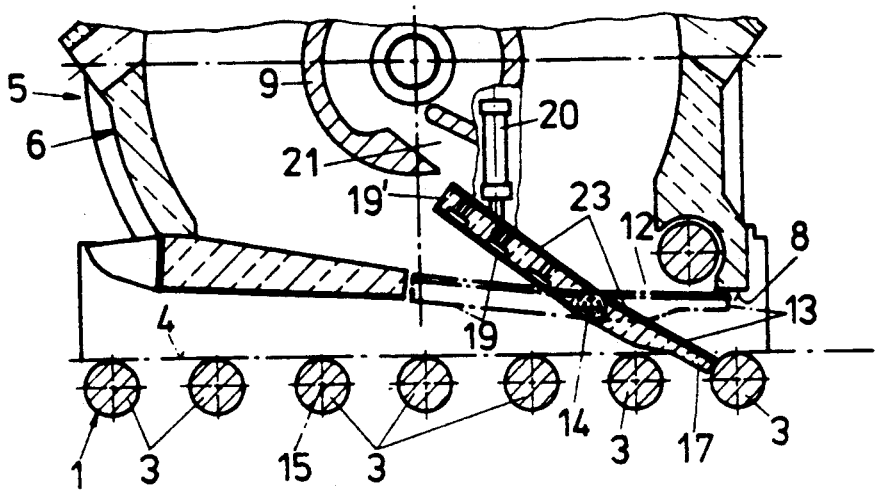
Figure 4:
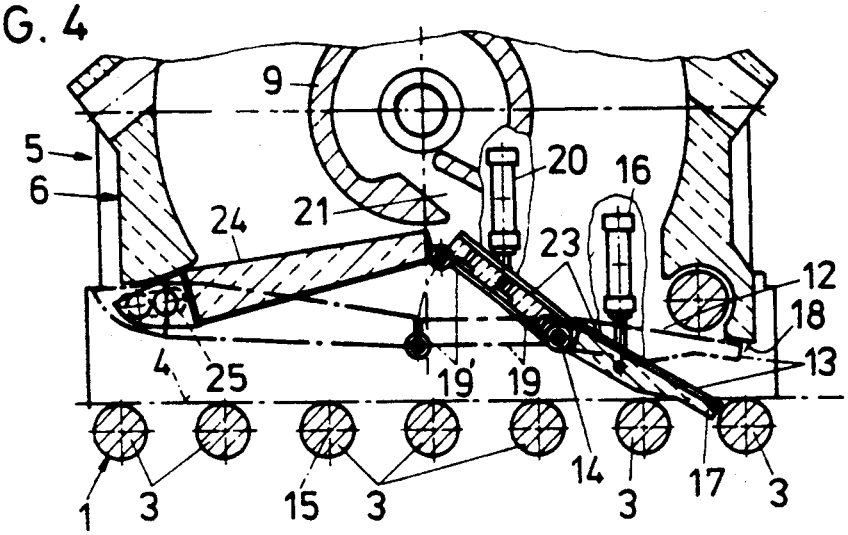
Figure 5:
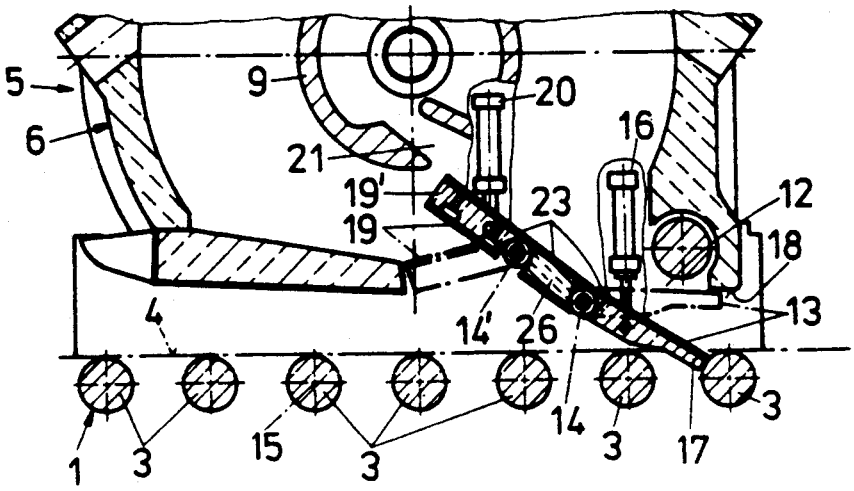

The invention will be explained in more detail by way of several exemplary embodiments with reference to the accompanying drawings, in which FIG. 1 is a vertical section through a coiler positioned above the roller table of a rolling mill;

FIG. 2 is a schematic side view of the coiler illustrated in FIG. 1; and FIGS. 3 to 5 represent further embodiments in schematic illustrations analogous to FIG. 1.

1 denotes the roller table of a rolling mill for rolling hot strip 2. Closely above the rollers 3, i.e., above the roller way 4 formed by the tangential plane laid at the rollers 3, there is positioned a coiler 5, whose housing 6 is provided with a heat insulating means 7 on its internal side. The coiler 5 is supported on the base by base supports 8. The mandrel 9, which is rotatably mounted in the center of the housing and is capable of being driven, optionally is heatable. If desired, also the housing 6 is provided with heating means 10 in order to be able to adjust a predetermined temperature within the housing.

The side 11 of the housing 6, that faces the roller table 4 is flattened and has an opening 12 in the region facing the rolling mill stand (not illustrated), through which opening the hot strip 2 can be introduced into the housing, as is illustrated in dot-and-dash lines. The opening 12 is closable by a first flap portion of pivot flap 13, which is movable, by means of a pressure medium cylinder 16, about a pivot bearing comprising a pivot axle 14 arranged approximately in the center of the opening 12 and parallel to the axes 15 of the rollers 3 of the roller table 1.

The pivot flap 13 is designed such that its free end 17 contacts the rim 18 of the opening 12, i.e., the housing 6, in the closed state of the opening 12 and projects between two table rollers 3 in the opened state of the opening 12 for the purpose of threading the hot strip 2 into the coiler. In doing so, the free end 17 of the pivot flap 13 gets to lie slightly below the roller way 4 formed by the table rollers 3.

The part of the opening 12 facing away from the rolling mill stand, which is not closable by the pivot flap 13, is closable by a second flap portion or flap part 19 that extends the pivot flap 13 in the direction opposite to its free end 17 and which is mounted to be pivotable about the same pivot axle 14 as the pivot flap 13 and movable about this pivot axle 14 by a separate pressure medium cylinder 20 independently of the pivot flap 13. This flap part 19 may assume two different positions, i.e., either may close the remaining opening 12, as is illustrated in FIG. 1 by broken lines, or may be pivoted with its free end 19' towards the mandrel 9 such that the hot strip 2 is transferred from the pivot flap 13 onto the flap part 19 extending the pivot flap and from there is led into a reception opening 21 of the mandrel 9. Both the pivot flap 12 and the flap part 19 are provided with heat insulating means 22 on their external sides. On their internal sides, steel rails 23 are arranged to perfectly guide the hot strip 2.

The coiler functions in the following manner:

At first, the pivot flap 12 and the flap part 19 extending the same are placed into the positions illustrated in full lines in FIG. 1, the hot strip 2, thus, being perfectly led to the reception opening 21 of the coiler mandrel 9. After having clamped the hot strip in the coiler mandrel 9, the flap part 19 is pivoted into the position closing the opening 12. The pivot flap 13 itself may be turned towards the rim 18 of the opening 12 to such an extent that just a passage for the hot strip 2 will remain clear, the opening 12 of the housing being closed almost entirely.

According to the embodiment illustrated in FIG. 3, the pivot flap 13 is rigidly connected with the flap part 19 extending the same such that the pivot flap 13 may be designed in one piece with the flap part 19, thereby providing the pivot flap assembly as a single element.

A single pressure medium cylinder 20 hinged to the flap part 19 suffices to move the pivot flap. In the opened position, there is no difference with respect to the embodiment depicted in FIG. 1. Only in the coiling position is the complete closure of the rear part of the opening 12 by the flap part 19 extending the pivot flap 13 not possible, yet temperature losses may be kept low if the insulating means 22 is present in a sufficient thickness such that no remarkable gap will be present between the flap part 19 illustrated in the closed position in broken lines in FIG. 3 and the housing 6.

According to FIG. 4, the pivot flap 13 and the flap part 19 are designed in a manner equal to the embodiment illustrated in FIG. 1, the pivot flap 13 being movable independently of the flap part 19. In order to avoid thermal losses, the flap part 19, with its end 19' facing away from the pivot axle 14, is articulately fastened to the housing wall part 24 following upon the opening. This housing wall part 24 is displaceable along a link guide 25 on the housing 6 and is pivotably mounted. Thus, the rear part of the opening 12 can be kept closed even in the threading position of the flap part 19, which part of the opening 12 is open according to the embodiment illustrated in FIG. 1.

According to the embodiment represented in FIG. 5, the pivot flap 13 and the flap part 19 extending the pivot flap 13 also are movable independently of each other, however, unlike with the embodiment illustrated in FIG. 1, the pivot axles 14, 14' of the pivot flap 13 and the flap part 19 are not identical, but are located at a distance from each other such that both the pivot flap and the flap part are pivotably mounted on a housing shell part 26 disposed between them.

The invention is not limited to the embodiments represented in the drawings, but may be modified in various aspects. For instance, it is possible to arrange the coiler 5 according to the invention also below the roller table 1, in which case the pivot flap 13 is designed in a manner that it may be pivoted, with its free end 17, between two table rollers 3 as far as to above the roller way 4. The flap part 19 extending the pivot flap 13 also may be arranged within the housing 6, the housing 6 reaching as far as to the pivot axle 14 of the pivot flap 13 below the flap part 19.

The pivot flap 13, with its flap part 19, also may be supported on the base independently of the housing 6, although it is preferred that both the pivot flap 13 and the flap part 19 are pivotably mounted directly on the housing 6 of the coiler 5. What is essential to the invention is that the pivot mounting, i.e., the pivot axle 14, of the pivot flap 13 and its flap part 19 is provided at a normal distance from the roller way 4.

What I claim is:

1. In a coiler arrangement for coiling hot metal rolling stock comprising a coiler mandrel rotatably mounted within a housing having a peripheral opening through which rolling stock is guided for coiling around said mandrel, said arrangement also including a roller table cooperatively disposed relative to said housing and formed of a plurality of table rollers defining a roller way upon which said rolling stock is transported to said coiler via said opening in said housing and guided to said mandrel by means of a pivot flap cooperatively associated with said roller table, said pivot flap extending from said roller table to the vicinity of said mandrel, said pivot flap being provided with means for actuating said flap into a position for guiding said rolling stock to said mandrel, the improvement which comprises:

a pivot flap assembly pivotably mounted on said housing by axle means located adjacent the peripheral opening thereof, said pivot flap assembly extending across said peripheral opening and having a first flap portion with its free end extending forwardly of said axle means and a second flap portion extending rearwardly thereof, said flap portions cooperating one with the other for closing off said opening and providing sufficient space to allow for passage of said rolling stock to said mandrel, and pivot drive means cooperatively associated with said housing for actuating said pivot flap assembly from an open to a closed position and vice versa.

2. The coiler arrangement of claim 1, wherein said first flap portion is integral with said second flap portion such that the pivot flap assembly is a single element.

3. The coiler arrangement of claim 1, wherein said first flap portion and said second flap portion are independently pivotable about said axle by separate pivot drive means.

4. The coiler arrangement of claim 3, wherein said second flap portion is hingedly connected to said first flap portion of said pivot flap assembly at said axle means.

5. The coiler arrangement of claim 4, wherein said housing has a housing wall part pivotably connected to said housing, said housing wall part being pivotably connected to said second flap portion.

6. The coiler arrangement as in claim 1, wherein said second flap portion is mounted pivotably on said housing independently of said first flap portion.

7. The coiler arrangement as in claim 1, wherein said housing and said pivot flap assembly are thermally insulated.

* * * * *